US008497054B2

(12) United States Patent
Sugiyama et al.

(10) Patent No.: US 8,497,054 B2
(45) Date of Patent: Jul. 30, 2013

(54) TONER

(75) Inventors: Akira Sugiyama, Yokohama (JP); Katsuyuki Nonaka, Mishima (JP); Koji Abe, Numazu (JP); Yasuhiro Hashimoto, Mishima (JP); Naoya Isono, Suntou-gun (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 343 days.

(21) Appl. No.: 12/908,402

(22) Filed: Oct. 20, 2010

(65) Prior Publication Data

US 2011/0097660 A1 Apr. 28, 2011

(30) Foreign Application Priority Data

Oct. 22, 2009 (JP) ..... 2009-243660

(51) Int. Cl.
*G03G 9/087* (2006.01)
*G03G 9/097* (2006.01)

(52) U.S. Cl.
CPC ..... *G03G 9/09708* (2013.01)
USPC ..... 430/108.6; 430/108.5

(58) Field of Classification Search
CPC ..... G03G 9/09708
USPC ..... 430/108.6, 108.5
See application file for complete search history.

(56) References Cited

U.S. PATENT DOCUMENTS

| | | | |
|---|---|---|---|
| 5,601,913 | A | 2/1997 | Ohtani et al. |
| 6,458,502 | B1 | 10/2002 | Nakamura et al. |
| 6,500,593 | B2 | 12/2002 | Abe et al. |
| 6,569,589 | B2 | 5/2003 | Inaba et al. |
| 7,014,969 | B2 | 3/2006 | Yachi et al. |
| 7,112,393 | B2 | 9/2006 | Komoto et al. |
| 7,250,241 | B2 | 7/2007 | Ayaki et al. |
| 7,300,737 | B2 | 11/2007 | Ayaki et al. |
| 7,309,558 | B1 | 12/2007 | Michel et al. ..... 430/137.1 |
| 7,459,253 | B2 | 12/2008 | Abe et al. |
| 7,704,661 | B2 | 4/2010 | Ikeda et al. |
| 2007/0259283 | A1 | 11/2007 | Abe et al. |
| 2009/0035688 | A1 | 2/2009 | Abe et al. |
| 2009/0087768 | A1 | 4/2009 | Tosaka et al. |
| 2009/0130582 | A1 | 5/2009 | Handa et al. |

FOREIGN PATENT DOCUMENTS

| | | | | |
|---|---|---|---|---|
| JP | 10067514 | A | * | 3/1998 |
| JP | 11327303 | A | * | 11/1999 |
| JP | 2002-244339 | A | | 8/2002 |
| JP | 2003-515795 | T | | 5/2003 |
| JP | 2005-070520 | A | | 3/2005 |
| JP | 2005070520 | A | * | 3/2005 |
| JP | 2007-241187 | A | | 9/2007 |

OTHER PUBLICATIONS

English language machine translation of JP 11-327303 (Nov. 1999).*
English language machine translation of JP 10-067514 (Mar. 1998).*
English language machine translation of JP 2005-070520 (Mar. 2005).*
Baerlocher, et al., "Atlas of Zeolite Framework Types", Elsevier, Sixth Revised Edition, 2007 (Title, Table of Contents, and Preface—6 pages).
Loewenstein, "The Distribution of Aluminum in the Tetrahedra of Silicates and Aluminates", American Mineralogist, vol. 39, No. 92, 1954, pp. 92-96.
U.S. Appl. No. 12/812,869, filed Jul. 14, 2010, Isono, et al.
U.S. Appl. No. 12/952,187, filed Nov. 22, 2010, Watanabe, et al.

* cited by examiner

*Primary Examiner* — Christopher Rodee
(74) *Attorney, Agent, or Firm* — Fitzpatrick, Cella, Harper & Scinto

(57) ABSTRACT

Provided is a toner in which faulty transfer under an extremely-low-temperature, low-humidity environment hardly occurs, including toner particles and a zeolite as an external additive, in which a ratio of the alminium atoms to a total of the silicon atoms and the aluminium atoms contained in the zeolite is 0.2 to 24.0%.

4 Claims, No Drawings

TONER

BACKGROUND OF THE INVENTION

1. Field of the Invention

The present invention relates to a toner for developing an electrostatic latent image for use in the development of an electrostatic latent image in an electrophotographic method or electrostatic recording method. More specifically, the present invention relates to a toner for use in an image-recording apparatus that can be utilized in a copying machine, printer or facsimile.

2. Description of the Related Art

In recent years, trends in technologies for printers have been directed toward the size reduction and speed-up of the machines. In addition, the printers have started to be used in various applications under various environments such as households and offices. In association with the above-mentioned diversification of the environments under which the printers are used, the printers have started to be used under a wide variety of environments ranging from an environment under which charging is hardly achieved as typified by a high-temperature and high-humidity environment to an environment under which excessive charging tends to occur as typified by a low-temperature and low-humidity environment.

It has been reported that the following problems generally occur under a high-temperature and high-humidity environment. That is, the so-called fogging in which faultily charged toner is printed even on a white portion of an image owing to faulty charging of toner, and the so-called faulty transfer in which the faultily charged toner is not sufficiently transferred occur. Particularly in the case where cardboard is used, heat tends to be absorbed by the paper surface, therefore, the quantity of heat to be applied to the toner for sufficiently fixing the toner on the cardboard has to be increased. In such case, the occurrence of the fogging causes the faultily charged toner to be additionally stretched, as a result, the problem of the fogging tends to be more remarkable than that in ordinary paper. In addition, when the toner is left to stand under the high-temperature and high-humidity environment, the charging of the toner tends to have difficulty in rising up owing to, for example, the moisture absorption of the toner or a charging member, as a result, a detrimental effect due to the faulty charging tends to be more likely to occur than in ordinary cases.

Meanwhile, with the advent of the diversification of the environments under which printers are used, the printers have started to be used even in cold climate areas each of which has a temperature as low as nearly 0° C. during nighttime hours and is under an extremely-low-temperature and low-humidity environment even during daytime hours. Under the extremely-low-temperature and low-humidity environment, excessive charging of toner particularly intends to occur, and problems such as faulty transfer due to an increase in electrostatic adhesive force of the toner and faulty regulation of the toner due to an increase in degree of electrostatic agglomeration tend to be more likely to occur than under a low-temperature, low-humidity environment where the toner has been conventionally used. In view of the foregoing, a toner capable of maintaining stable chargeability under any environment has been required.

It has been reported as one approach to improve chargeability that charging stability can be improved by melting and kneading a salt-like structured silicate as a charge control agent into toner (see, for example, Japanese Translation of PCT International Application Publication No. 2003-515795 and Japanese Patent Application Laid-Open No. 2007-241187). It has also been reported as another approach that a reduction in chargeability under a high-temperature and high-humidity environment can be suppressed by mixing a zeolite into a charge control resin having a sulfonic group as a substituent to cap the sulfonic group with the pores of the zeolite (see, for example, Japanese Patent Application Laid-Open No. 2005-070520). However, the zeolite used in the above-mentioned approaches has a large ratio of aluminum, and the water-absorbing property of the zeolite itself is high, therefore, it has been difficult to say that charge of the toner is sufficiently controlled under the high-temperature and high-humidity environment. Further, it is found that, in the above-mentioned approaches, the zeolite is present in the toner, and the addition of the zeolite exerts a small improving effect on triboelectric charging, and hence such a problem that sufficient charge rising performance cannot be obtained in printing after the toner has been left to stand for a while following printing on a large number of sheets particularly under the high-temperature and high-humidity environment arises.

It has also been reported that chargeability after printing on a large number of sheets can be improved by causing zeolite particles to adhere to toner particles in order to suppress the contamination of a member (see, for example, Japanese Patent Application Laid-Open No. 2002-244339). However, a zeolite used in the above-mentioned approach has a large ratio of aluminum, and the water-absorbing property of the zeolite itself is high, therefore, there has been a problem that charge rising performance cannot be obtained under a high-temperature and high-humidity environment.

As described above, no conventional toner can sufficiently provide satisfactory images under any use environment in high-speed, long-lifetime machines currently requested in the market. Accordingly, additional improvements have been demanded at present.

SUMMARY OF THE INVENTION

An object of the present invention is to provide a toner that has solved the above-mentioned problems.

That is, the object of the present invention is to provide a toner having good chargeability under any environment, and hence fogging hardly occurs at the time of development even when the toner is left to stand under a high-temperature and high-humidity environment, and furthermore, faulty transfer hardly occurs even at the time of development under an extremely-low-temperature and low-humidity environment.

The inventors of the present invention have conducted extensive studies, and as a result, have found that the above-mentioned problems can be solved by the following constitution. Thus, the inventors of the present invention have accomplished the present invention.

That is, the present invention relate to a toner containing toner particles and a zeolite as an external additive, in which the zeolite contains at least silicon atoms and aluminum atoms, and a ratio of the aluminum atoms to a total of the silicon atoms and the aluminum atoms in the zeolite is 0.2 to 24.0%.

According to the present invention, good chargeability can be obtained even under a high-temperature and high-humidity environment, and excessive charging can be suppressed under an extremely-low-temperature and low-humidity environment.

That is, there can be provided a toner in which fogging hardly occurs when the toner is left to stand under a high-temperature and high-humidity environment, and faulty transfer hardly occurs under an extremely-low-temperature and low-humidity environment.

Further features of the present invention will become apparent from the following description of exemplary embodiments.

DESCRIPTION OF THE EMBODIMENTS

Hereinafter, the present invention is described in detail by showing an embodiment of the present invention.

A toner of the present invention is a toner obtained by externally adding a zeolite to toner particles, and is characterized in that the zeolite contains at least silicon atoms and aluminum atoms, and a ratio (%) of the aluminum atoms to the total of the silicon atoms and the aluminum atoms in the zeolite ranges from 0.2 to 24.0.

In general, the term "zeolite" is a generic name for aluminosilicates each having fine pores in its crystal, and the zeolite has regular fine pores in its crystal.

The basic units of the structure of an aluminosilicate are $(SiO_4)4$- and $(AlO_4)5$-units each having a tetrahedral structure (collectively referred to as "TO4 unit"). One TO4 unit shares four oxygen atoms at apexes with four adjacent TO4 units so that the units are three-dimensionally linked one after another to form the crystal ("Science and Engineering of Zeolites" published by Kodansha Scientific Ltd.).

It should be noted that a metallosilicate obtained by substituting aluminum in a crystalline, porous aluminosilicate with any other metal is also included in the category of the zeolites, but the zeolite used in the present invention is a zeolite containing at least a silicon atom and an aluminum atom as elements of which the zeolite is constituted.

It has been generally reported that a silicon atom is bonded to an aluminum atom in a zeolite through an oxygen atom. Accordingly, silicon atoms and aluminum atoms are considered to be present in the crystal of the zeolite in high dispersed state ("Amer. Mineral." 39, 92 (1954)).

In addition, a zeolite has a structure in which cations such as $Na^+$ and $H^+$ are distributed because a silicon skeleton itself has negative charge by virtue of the presence of an aluminum atom in the skeleton.

It has been generally known that toner particles and silica are in almost same triboelectric series, on the other hand, alumina has higher positive chargeability than that of toner particles.

Accordingly, the following situation is conceivable. That is, toner particles are triboelectrically charged by an aluminum atom part having positive chargeability in a zeolite as one kind of a composite oxide of silica and alumina, and hence the chargeability of each of the toner particles is improved. Accordingly, the above-mentioned advantageous effect is significantly provided in case that the toner of the present invention contains negatively chargeable toner particles.

However, a zeolite to be generally used contains a large amount of aluminum in its crystal structure, and hence the amount of an alumina part having high hydrophilicity increases, and the water-absorbing property of the zeolite is raised, as a result, a moisture adsorption has tended to increase under a high-temperature and high-humidity environment.

The inventors of the present invention have made extensive studies, and as a result, have found that faulty charging under a high-temperature and high-humidity environment, and excessive charging under an extremely-low-temperature and low-humidity environment can be suppressed by externally adding a zeolite having a properly controlled amount of aluminum atoms in its crystal to toner particles. Such zeolite is a "high-silica zeolite" containing a suppressed amount of aluminum and a relatively large amount of silicon.

That is, the inventors of the present invention have found that the problem of the so-called fogging in which faultily charged toner is printed even on a white portion of an image is suppressed even when the above-mentioned toner is left to stand under a high-temperature and high-humidity environment.

Meanwhile, the inventors of the present invention have found that excessive charging of the toner particles can be suppressed under an extremely-low-temperature and low-humidity environment, and hence faulty transfer due to an increase in electrostatic adhesive force of the toner caused by the excessive charging is suppressed. Although specific mechanisms for the foregoing have not been elucidated yet, the inventors of the present invention assume as described below.

Unlike simple silica-alumina composite oxides, the zeolites each have a regular crystal structure in which aluminum atoms are highly dispersed, and hence aluminum atoms on the crystal surface can also be highly dispersed.

Further, the zeolites are each a porous material having regular pores, and therefore a part on which the aluminum atoms on the crystal surface locally converge hardly exists, and hence local adsorption of water hardly occur as compared with that in any one of the simple silica-alumina composite oxides.

Since amount of aluminum atom in the zeolite of the present invention is smaller than that of a general zeolite, the zeolite of the present invention may be less susceptible to moisture adsorption than the general zeolite is.

In addition, in the toner o f the present invention, the zeolite is externally added to the toner particles, as a result, an effect for improving the triboelectric chargeability of the toner itself may be further obtained by friction between the aluminum atoms in the zeolite and the toner particles.

Furthermore, the aluminum atoms are highly dispersed in the crystal structure, and the zeolite itself is a porous body, as a result, the zeolite has a sufficient charge rising effect even at small aluminum content as compared with those of the simple silica-alumina composite oxides.

Accordingly, the following situation is conceivable. That is, even when the toner of the present invention is left to stand under a high-temperature and high-humidity environment, the zeolite does not excessively adsorb moisture, and the highly dispersed aluminum atoms markedly improve charge rising performance based on triboelectric charging between the toner particles.

Meanwhile, the following situation is conceivable under a low-temperature and low-humidity environment. That is, the zeolite is a porous material having a large amount of a hydrophobic silica component, and hence a moderate but not excessive amount of moisture can be retained in the crystal, and the moisture suppresses excessive charging.

The ratio of the aluminum atoms to the total of the silicon atoms and the aluminum atoms in the zeolite used in the toner of the present invention is 0.2 to 24.0%, preferably 0.2 to 12.0% from the viewpoints of additional improvements of the effects of the present invention, or more preferably 1.5 to 12.0%.

When the ratio of the aluminum atoms is less than 0.2%, an effect exerted by the aluminum atoms becomes small, and therefore, a charge rising effect under a high-temperature and high-humidity environment is insufficient, and excessive charging tends to occur under a low-temperature and low-humidity environment.

In addition, when the ratio of the aluminum atoms is larger than 24.0%, the water-absorbing property of each of the aluminum atoms exerts a large effect, and therefore, faulty charging under a high-temperature and high-humidity environment tends to occur.

It should be noted that the zeolite and any silica-alumina composite oxide can be distinguished from each other by performing X-ray diffraction with an X-ray diffraction apparatus depending on whether or not a crystal structure is present.

The above-mentioned zeolite has a BET specific surface area of preferably 350 $m^2/g$ or more and 750 $m^2/g$ or less, or more preferably 500 $m^2/g$ or more and 700 $m^2/g$ or less. When the BET specific surface area falls within the above-mentioned range, the dispersibility of each of the aluminum atoms in the crystal is improved, and thereby, an improving effect of each of the aluminum atoms on chargeability becomes additionally significant. In addition, moisture tends to be physically adsorbed to the inside of the crystal, and hence a suppressing effect on charge-up under a low-temperature and low-humidity environment becomes additionally significant.

The primary particle diameter D50y of the above-mentioned zeolite is preferably 0.01 μm or more and 1.50 μm or less, or more preferably 0.05 μm or more and 0.50 μm or less.

When the D50y falls within the above-mentioned range, an effect derived from the pores of the zeolite becomes significant, and furthermore, the stability of the zeolite is improved. Further, a state of adhesion of the zeolite upon external addition to the toner particles becomes easily uniform.

The agglomeration diameter D50z of the zeolite is preferably 0.10 μm or more and 7.00 μm or less, or more preferably 0.20 μm or more and 3.50 μm or less.

When the D50z satisfies the above-mentioned range, the zeolite can be present on the surface of each toner particles in a further uniform and stable manner.

The crystal structure of the zeolite in the present invention is not limited in any way, and is exemplified by the following structures: sodalite (SOD), AlPO4-11 (AEL), EU-1 (EUO), ferrierite (FER), heulandite (HEU), ZSM-5 (MFI), NU-87 (NES), theta-1 (TON), weinebeneite (WEI), AlPO4-5(AFI), AlPO4-31 (ATO), beta (BEA), CIT-1 (CON), X (FAU), Y (FAU), USY (FAU), faujasite (FAU), L (LTL), mordenite (MOR), cancrinite (CAN), gmelinite (GME), ZSM-12 (MTW), offretite (OFF), cloverite (-CLO), VPI-5 (VFI), AlPO4-8 (AET), CIT-5 (CFI) and UTD-1(DON).

Here, symbols in parentheses given to the zeolite names exemplified above denote structure codes (cited from: W. H. Meier, D. H. Olson, Ch. Baelocher ed., Atlas of Zeolite Structure Types, 4th Ed., Elsevier, 1996).

In addition, cationic species in the zeolite is exemplified by the following: $H^+$, $NH^{4+}$, $Ag^+$, $K^+$, $Li^+$, $Ca^{2+}$, $Mg^{2+}$, $Ba^{2+}$, $Sr^{2+}$, $Zn^{2+}$, $Pb^{2+}$, $Ni^{2+}$, $Cu^{2+}$, $Co^{2+}$, $Mn^{2+}$, or a combination thereof.

It should be noted that one kind of those zeolites can be used alone, or two or more kinds of them can be used as a mixture.

The crystal shape of the zeolite of the present invention is not particularly limited.

Examples of the shape include a polyhedral shape, a spherical shape and a needle shape. Of those shapes, a shape as close to the spherical shape as possible is preferred because good triboelectric charging occurs upon external addition to the toner particles.

The addition amount of the zeolite is preferably 0.01 to 5.00 parts by mass, or more preferably 0.10 part by mass to 2.00 parts by mass with respect to 100.00 parts by mass of the toner particles.

When the addition amount of the zeolite is 0.01 part by mass or more, a sufficient effect provided by the zeolite addition can be obtained, while no troubles such as the contamination of a member are caused.

As the zeolite used in the present invention, commercially available product having a ratio between silicon atoms and aluminum atoms within the range specified in the present invention can be used.

The toner particles of the present invention each preferably contain a polymer or copolymer having a sulfonic group, sulfonate group or sulfonic acid ester group.

Specifically, polymers and copolymers each having the following structure and each having a sulfonic group or sulfonate group are exemplified:

$$X(SO_3^-)n \cdot mY^{k+}$$

(where X represents a polymer site or copolymer site derived from a polymerizable monomer, $Y^{k+}$ represents a counter ion, k represents the valence of the counter ion, and m and n represent integers and satisfy the relationship of $n=k\times m$).

In this case, the counter ion is preferably a hydrogen ion, a sodium ion, a potassium ion, a calcium ion or an ammonium ion.

Examples of the above-mentioned polymer or copolymer having a sulfonic group, a sulfonate group or a sulfonic acid ester group include a polymer or copolymer including one or more kinds of monomers selected from the group consisting of styrenesulfonic acid, 2-acrylamide-2-methylpropanesulfonic acid, 2-methacrylamide-2-methylpropane sulfonic acid, vinylsulfonic acid, methacrylsulfonic acid and alkyl esters thereof, as a constituent component.

In addition, a monomer to be polymerized with any one of the above-mentioned monomers to form a copolymer is, for example, a vinyl-based polymerizable monomer, and a monofunctional polymerizable monomer or a polyfunctional polymerizable monomer can be used.

In the case the copolymer is used, the form of the copolymer is not particularly limited, and examples of the form of the copolymer include a random copolymer, a block copolymer and a graft copolymer. Although the molecular weight of the above-mentioned polymer or copolymer is not particularly limited, the polymer or copolymer preferably has an Mn of 5000 to 30,000 and an Mw of 10,000 to 50,000.

In the case the copolymer is used, the ratio of monomers each having a sulfonic group or the like is 2.0 to 14.0 mass % with respect to all monomers of which the copolymer is constituted.

By containing the polymer or copolymer additionally improves charging stability under a high-temperature and high-humidity environment. In addition, the polymer or copolymer has high negative chargeability, and hence the charge rising performance of each of the toner particles tends to be additionally improved by triboelectric charging with an aluminum part in the zeolite.

The addition amount of the polymer or copolymer is preferably 0.01 to 20.00 parts by mass, or more preferably 0.30 to 10.00 parts by mass with respect to 100.00 parts by mass of a polymerizable monomer of which a binder resin in each of the toner particles is constituted.

When the addition amount of the polymer or copolymer falls within the above-mentioned range, an effect of the addition can be sufficiently obtained and the adsorption of moisture in the air by the toner particles can be suppressed.

A method of producing the toner particles of which the toner of the present invention is constituted is not particularly limited, and any one of the known production methods can be employed.

Preferably employed for producing the toner particles of the present invention out of the known production methods is a method involving: adding a polymerizable monomer composition containing at least a polymerizable monomer and a colorant to an aqueous medium; granulating the polymerizable monomer composition in the aqueous medium to form polymerizable monomer composition particles; and polymerizing the polymerizable monomer in each of the polymerizable monomer composition particles.

The toner particles produced by such method have a sharp particle size distribution, and hence a toner having a high circularity can be easily obtained. In addition, such toner is excellent in flowability, and can provide excellent triboelectric chargeability.

Furthermore, particularly when the above-mentioned polymer or copolymer having a sulfonic group, sulfonate group or sulfonic acid ester group is included in the toner particles, the polymer can be easily present on the surface of each toner particles, and thereby, an effect of the addition of the polymer can be easily obtained.

Hereinafter, a method of producing the toner particles used in the present invention is described by taking a suspension polymerization method which is most suitable for obtaining the toner particles as an example.

A polymerizable monomer and a colorant, and any other additive such as a polar resin or release agent to be used as required are uniformly dissolved or dispersed with a dispersing machine such as a homogenizer, a ball mill, a colloid mill or an ultrasonic dispersing machine, and then a polymerization initiator is dissolved in the resultant to prepare a polymerizable monomer composition.

Next, the polymerizable monomer composition is dispersed in an aqueous medium containing a dispersion stabilizer, and is then granulated to form particles. The polymerizable monomer in each of the particles is polymerized to produce the toner particles.

The polymerization initiator can be added simultaneously with the addition of the other additive to the polymerizable monomer, or can be mixed immediately before the dispersion of the polymerizable monomer composition in the aqueous medium.

Alternatively, the polymerization initiator dissolved in the polymerizable monomer or a solvent can be added immediately before the granulation and prior to the initiation of the polymerization reaction.

In the present invention, an appropriate acid is preferably added for pH adjustment at the time of the dispersion, at the time of the granulation, and prior to the initiation of the polymerization reaction. An acid that has been generally used such as hydrochloric acid, sulfuric acid or nitric acid can be used as an acid to be used in the toner of the present invention. A toner having further uniform chargeability can be obtained by adjusting the pH of the aqueous solution at the time of the polymerization to an appropriate value.

When the toner particles of the present invention each contain the polar resin, the addition of the polar resin at the time of the polymerization reaction commencing on the step of dispersing the polymerizable monomer composition and ending on the step of polymerizing the polymerizable monomer composition can control the state of presence of the polar resin depending on a balance between the polarity of the polymerizable monomer composition to serve as the toner particles and the polarity of the aqueous dispersion medium.

That is, the addition of the polar resin enables function separation in association with a resin layer. In addition, the toner particles obtained by the suspension polymerization method are preferably used, because the particles each have a core-shell structure in which a release agent component is enclosed.

Examples of the polar resin include a polyester resin, an epoxy resin, a styrene-acrylic acid copolymer, a styrene-methacrylic acid copolymer and a styrene-maleic acid copolymer.

Of those, the polyester resin is particularly preferred, and the acid value of the polar resin preferably falls within the range of 4 to 20 mgKOH/g.

In addition, with regard to a molecular weight, the polar resin preferably has a main peak molecular weight of 3000 to 30,000 because the flowability and negative triboelectric charging characteristic of each of the toner particles can be improved.

The addition amount of the polar resin is preferably 1 to 25 parts by mass, or more preferably 2 to 15 parts by mass with respect to 100 parts by mass of the polymerizable monomer of which the binder resin is constituted.

Examples of the polymerizable monomer of which the binder resin used in the toner of the present invention is constituted include a styrene-acrylic copolymer, a styrene-methacrylic copolymer, an epoxy resin and a styrene-butadiene copolymer that are generally used.

A vinyl-based polymerizable monomer capable of radical polymerization can be used as the polymerizable monomer of which the binder resin is constituted. A monofunctional polymerizable monomer or a polyfunctional polymerizable monomer can be used as the vinyl-based polymerizable monomer.

Examples of the polymerizable monomer for forming the binder resin include the following: styrene; styrene-based monomers such as o-(m-, p-)methylstyrene and m-(p-)ethylstyrene; acrylic acid ester-based monomers and methacrylic acid ester-based monomers such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate and diethylaminoethyl methacrylate; ene-based monomers such as butadiene, isoprene, cyclohexene, acrylonitrile, methacrylonitrile, acrylamide and methacrylamide.

Those polymerizable monomers is used alone, or generally appropriately mixed before use so that the mixture shows a theoretical glass transition point (Tg) described in a publication "Polymer Handbook, second edition, III-p 139 to 192 (published by John Wiley & Sons)" of 40° C. to 75° C.

In the present invention, a low-molecular weight polymer can be added for controlling the molecular weight distribution of tetrahydrofuran (THF) soluble matter of the toner to a preferred molecular weight distribution to improve low-temperature fixability. When the toner particles are produced by the suspension polymerization method, the low-molecular weight polymer can be added to the polymerizable monomer composition.

The low-molecular weight polymer preferably has a weight-average molecular weight (Mw) measured by gel permeation chromatography (GPC) in the range of 2000 to 5000 and a ratio Mw/Mn of less than 4.5, or more preferably less than 3.0 in terms of fixing performance and developing performance. Examples of the low-molecular weight polymer include the following polymers.

Homopolymers of styrene and its substitution products, such as polystyrene and polyvinyltoluene; styrene-based copolymers such as a styrene-propylene copolymer, a styrene-vinyl toluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer and a styrene-maleic acid ester copolymer; polymethyl methacrylate, polybutyl methacrylate, polyvinyl acetate, polyethylene, polypropylene, polyvinyl butyral, a silicone resin, a polyester resin, a polyamide resin, an epoxy resin, a polyacrylate resin, rosin, modified rosin, a terpene resin, a phenolic resin, an aliphatic or alicyclic hydrocarbon resin, and an aromatic petroleum resin.

It should be noted that the above-mentioned low-molecular polymers can be used alone or as a mixture.

Of those low-molecular weight polymers, a low-molecular weight polymer having a glass transition point of 40 to 100° C. is preferably used. When the glass transition point is less than 40° C., the toner particles tend to deteriorate. On the other hand, when the glass transition point exceeds 100° C., a problem called faulty fixation tends to occur. The glass transition point of the low-molecular weight resin is preferably 40 to 70° C., or more preferably to 65° C. because low-temperature fixability can be obtained.

The addition amount of the low-molecular weight polymer is preferably 0.1 to 75.0 parts by mass with respect to 100.0 parts by mass of the polymerizable monomer of which the binder resin in each of the toner particles is constituted.

In the present invention, a crosslinking agent can be used at the time of the synthesis of the binder resin for controlling the molecular weight of the THF soluble matter of the toner as well as for improving the mechanical strength of each of the toner particles.

Examples of the bifunctional crosslinking agent include: divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester-type diacrylates (MANDA, Nippon Kayaku Co., Ltd.), and those obtained by changing the diacrylates to dimethacrylates.

The examples of the polyfunctional crosslinking agent include: pentaerythritol triacrylate, trimethylolethane triacrylate, trimethylolpropane triacrylate, tetramethylolmethane tetraacrylate, oligoester acrylate and a methacrylate thereof, 2,2-bis(4-methacryloxypolyethoxyphenyl)propane, diallylphthalate, triallylcyanurate, triallylisocyanurate and triallyltrimelitate.

The addition amount of those crosslinking agents is preferably 0.05 to 10.00 parts by mass, or more preferably 0.10 to 5.00 parts by mass with respect to 100.00 parts by mass of the polymerizable monomer.

In the present invention, a release agent is preferably used. The content of the release agent is preferably 4.0 to 25.0 parts by mass, or more preferably 7.0 to 15.0 parts by mass with respect to 100.0 parts by mass of the binder resin or the polymerizable monomer.

Furthermore, the release agent has a peak temperature of the highest endothermic peak in the range of preferably 40 to 110° C., or more preferably 45 to 90° C. in a DSC curve at the time of a temperature increase measured with a differential scanning calorimeter (DSC).

The release agent to be used in the present invention is particularly preferably a release agent having a small amount of a polar component such as a hydrocarbon-based release agent because such release agent is easily enclosed in the central portion of each toner particle.

Examples of the hydrocarbon-based release agent include: petroleum waxes such as a paraffin wax, a microcrystalline wax and petrolatam, and derivatives thereof; a Fischer-Tropsch wax obtained by a Fischer-Tropsch process and derivatives thereof; polyolefin waxes such as a polyethylene wax and polypropylene wax, and derivatives thereof. Examples of the derivatives include an oxide, a block copolymer with a vinyl monomer, and a graft-modified product. The examples further include hardened castor oil and a derivative of the oil, a vegetable wax and an animal wax. Those waxes can be used alone, or two or more kinds of them can be used in combination.

It should be noted that an antioxidant can be added to any one of those hydrocarbon-based release agents to such an extent that the chargeability of the toner is not affected.

Examples of other release agents include an amide wax, a higher fatty acid, a long-chain alcohol, a ketone wax and an ester wax, and their derivatives such as graft compounds and block compounds. Two or more kinds of release agents can be used in combination as required.

Examples of the polymerization initiator which can be used in the toner of the present invention: azo type Or diazo type polymerization initiators such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile and azobisisobutyronitrile; and peroxide-based polymerization initiators such as benzoyl peroxide, methyl ethyl ketone peroxide, diisopropyl peroxycarbonate, cumenehydroperoxide, 2,4-dichlorobenzoyl peroxide, lauroyl peroxide and tert-butyl-peroxypivalate.

The used amount of those polymerization initiators, which varies depending on the target degree of polymerization, is generally 3 to 20 parts by mass with respect to 100 parts by mass of the polymerizable vinyl-based monomer.

The kinds of polymerization initiators vary slightly depending on a polymerization method. One kind of the polymerization initiators can be used alone, or two or more kinds of them can be used as a mixture with reference to a 10-hour half-life temperature.

The toner of the present invention contains a colorant as an essential component for imparting coloring power. Examples of the colorant to be preferably used in the present invention include the following organic pigments, organic dyes and inorganic pigments.

As the organic pigment or the organic dye as a cyan-based colorant, a copper phthalocyanine compound and derivatives thereof, an anthraquinone compound, and a lake compound of basic dyes are exemplified.

Specific examples thereof include the following:

C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60 and C.I. Pigment Blue 62.

Examples of the organic pigment or the organic dye as a magenta type colorant include the following: a condensed azo compound, a diketopyrrolopyrrole compound, anthraquinone, a quinacridone compound, a lake compound of basic dyes, a naphthol compound, a benzimidazolone compound, a thioindigo compound and a perylene compound.

Specific examples include the following:

C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As the organic pigment or the organic dye as a yellow type colorant, the compound typified by a condensed azo compound, an isoindolinone compound, an anthraquinone compound, an azo metal complex, a methine compound or an allylamide compound is exemplified.

Specific examples include the following:

C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

As a black colorant, there are exemplified carbon black and a colorant toned to have a black color by using the yellow type colorant/magenta type colorant/cyan type colorant.

Those colorants can be used alone, or two or more kinds of them can be used as a mixture. Further, each of those colorants can be used in a solid solution state. The colorant to be used in the toner of the present invention is selected in terms of hue angle, chroma, brightness, light resistance, OHP transparency, and dispersibility into the toner.

The addition amount of the colorant is preferably 1 to 20 parts by mass with respect to 100 parts by mass of the binder resin or polymerizable monomer.

When the toner particles are obtained by employing a polymerization method in the present invention, attention must be paid to the polymerization-inhibiting property and aqueous phase-migrating property of the colorant. The colorant is preferably subjected to a hydrophobic treatment with a substance that does not inhibit polymerization. Particular attention must be paid upon use of any one of the dye-based colorants and the carbon blacks because many of them each have polymerization-inhibiting property. In addition, a method of suppressing the polymerization-inhibiting property of each of those dye-based colorants is, for example, a method involving polymerizing the polymerizable monomer in the presence of the dye in advance, and the resultant colored polymer is added to the polymerizable monomer composition. In addition, each of the carbon blacks may be subjected to a treatment with a substance that reacts with a surface functional group of the carbon black (such as polyorganosiloxane) as well as the same treatment as that in the case of each of the dyes.

Any one of known inorganic and organic dispersion stabilizer can be used as the dispersion stabilizer at the time of the preparation of the aqueous medium.

Specific examples of the inorganic dispersion stabilizer include the following: tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina.

Furthermore, examples of the organic dispersion stabilizer include the following: polyvinyl alcohol, gelatin, methylcellulose, methylhydroxypropylcellulose, ethylcellulose, a sodium salt of carboxymethylcellulose, and starch.

In addition, a commercially available nonionic, anionic or cationic surfactant can be used. Examples of the surfactant include the following: sodium dodecyl sulfate, sodium tetradecyl sulfate, sodium pentadecyl sulfate, sodium octyl sulfate, sodium oleate, sodium laurate, potassium stearate and calcium oleate.

An inorganic, hardly water-soluble dispersion stabilizer is preferably used as the dispersion stabilizer to be used at the time of the preparation of the aqueous medium which is used in preparation of the toner of the present invention, and moreover, a hardly water-soluble, inorganic dispersion stabilizer which is soluble in an acid is more preferably used as the dispersion stabilizer.

In addition, in the present invention, when an aqueous medium is prepared, the used amount of such dispersion stabilizer is preferably 0.2 to 2.0 parts by mass with respect to 100.0 parts by mass of the polymerizable monomer.

In addition, in the present invention, an aqueous medium is preferably prepared with water in an amount of 300 to 3000 parts by mass with respect to 100 parts by mass of the polymerizable monomer composition.

In the present invention, when an aqueous medium into which the dispersion stabilizer is dispersed is prepared, a commercially available dispersion stabilizer can be dispersed as it is.

In addition, in order to obtain dispersion stabilizer particles each having a fine, uniform grain size, an aqueous medium can be prepared by producing the dispersion stabilizer in a liquid medium such as water under high-speed stirring.

For example, when tricalcium phosphate is used as a dispersion stabilizer, a preferred dispersion stabilizer can be obtained by mixing an aqueous solution of sodium phosphate and an aqueous solution of calcium chloride under high-speed stirring to form fine particles of tricalcium phosphate.

In the toner of the present invention, a charge control agent can be used by being mixed with the toner particles as required. Blending the charge control agent can: improve and stabilize a charging characteristic; and control an optimum triboelectric charge quantity in accordance with a developing system.

Any one of the known charge control agents can be utilized as the charge control agent, and a charge control agent having a high charging speed and capable of stably maintaining a constant charge quantity is particularly preferred.

Furthermore, when the toner particles are produced by a direct polymerzation method, a charge control agent having low polymerization-inhibiting property and containing a small amount of matter soluble in the aqueous medium is particularly preferred.

An organometallic compound and a chelate compound are each effectively used as a charge control agent for controlling the toner so that the toner is negatively chargeable, and examples of the agent include: monoazo metal compounds; acetylacetone metal compounds; and aromatic oxycarboxylic acid-, aromatic dicarboxylic acid-, oxycarboxylic acid- and dicarboxylic acid-based metal compounds.

The examples also include: aromatic oxycarboxylic acids, aromatic monocarboxylic and polycarboxylic acids, and metal salts, anhydrides and esters of the acids; and phenol derivatives such as bisphenol. The examples further include a urea derivative, a metal-containing salicylic acid-based compound, a metal-containing naphthaic acid-based compound, a boron compound, a quaternary ammonium salt, a calixarene and a charge control resin.

Of those, a polymer having a sulfonic acid-based functional group described above as the charge control agent is preferably a polymer or copolymer having a sulfonic group, sulfonate group or sulfonic acid ester group by reason of the foregoing.

The toner of the present invention can contain one kind of those charge control agents alone, or can contain two or more kinds of them in combination.

The amount of the charge control agent which is contained in toner particles is preferably 0.01 to 20.00 parts by mass, or more preferably 0.30 to 10.00 parts by mass with respect to 100.00 parts by mass of the polymerizable monomer.

In the toner of the present invention, an inorganic fine powder as well as the zeolite can be externally added as required.

Examples of the inorganic fine powder include fine powders such as a silica fine powder, a titanium oxide fine powder, an alumina fine powder, and multiple oxide fine powders of them. Of the inorganic fine powders, the silica fine powder and the titanium oxide fine powder are preferably used.

Examples of the silica fine powder include: dry silica or fumed silica produced by the vapor-phase oxidation of a silicon halide; and wet silica produced from water glass.

The dry silica is preferably used as the inorganic fine powder because the number of silanol groups present on the surface of, and in, the silica fine powder is small, and the amounts of $Na_2O$ and $SO_3^{2-}$ are small. In addition, the dry silica can be a composite fine powder of silica and any other metal oxide obtained by using a metal halide such as aluminum chloride or titanium chloride together with the silicon halide in a production process for the silica.

The inorganic fine powder is externally added to the toner particles for improving the flowability of the toner and uniformizing the charging of the toner particles.

When the inorganic fine powder is subjected to a hydrophobic treatment, the adjustment of the charge quantity of the toner, an improvement in environmental stability of the toner, and improvements in characteristics of the toner under a high-humidity environment can be achieved. Accordingly, an inorganic fine powder subjected to a hydrophobic treatment is preferably used.

When the inorganic fine powder added to the toner absorbs moisture, the following tendency is observed. That is, the charge quantity of the toner reduces, a reduction in developing performance or transferring performance intends to occur, and durability under a hostile environment reduces.

Examples of hydrophobic treatment agents for the inorganic fine powder include an unmodified silicone varnish, various modified silicone varnishes, an unmodified silicone oil, various modified silicone oils, a silane compound, a silane coupling agent, and other organic silicon compounds and organic titanium compounds. One kind of those treatment agents can be used alone, or two or more kinds of them can be used in combination.

Of those, the inorganic fine powder treated with a silicone oil is preferred.

A hydrophobized inorganic fine powder obtained by hydrophobizing an inorganic fine powder with a silicone oil simultaneously with or after a hydrophobic treatment with a coupling agent is more preferably used, because the charge quantity of each toner particle can be maintained at a high level even under a high-humidity environment and hence stable images can be provided.

The total amount of the inorganic fine powder excluding the zeolite is preferably 1.0 to 5.0 parts by mass with respect to 100.0 parts by mass of the toner particles.

An apparatus used in the external addition step of the present invention is not particularly limited as long as the characteristics can be achieved, and any known product ion method can be employed. Examples of the apparatus include existing, high-speed stirring mixers such as a Henschel mixer and a Super mixer.

Next, various measurement methods in the present invention are described.

<Measurement of Ratio (%) of Aluminum Atoms to Total of Silicon Atoms and Aluminum Atoms in Zeolite>

The ratio of the aluminum atoms to the total of the silicon atoms and the aluminum atoms in the zeolite used in the present invention can be measured with a fluorescent X-ray analyzer. Hereinafter, a measurement method in the present invention is described.

The masses of elements ranging from Na to U in the zeolite are directly measured with a wavelength dispersive fluorescent X-ray analyzer Axios advanced (manufactured by PANalytical) under a He atmosphere by an FP method.

At that time, all the detected elements are assumed as oxides, and their total mass is defined as 100%. The content (mass %) of at least one of $SiO_2$ and $Al_2O_3$ with respect to the total mass is determined as a value in terms of an oxide with a software UniQuant (registered trademark) 5 (ver. 5.49) (distributor: PANalytical).

Next, the abundance ratios of the silicon atoms and the aluminum atoms are calculated from the resultant content, and then the ratio (%) of the aluminum atoms to the total of the silicon atoms and the aluminum atoms is calculated from the following equation (1).

$$\text{Ratio of Aluminum atom}(\%) = \frac{\text{Abundance ratio of Aluminum atom}(\%)}{\text{Abundance ratio of silicon atom}(\%) + \text{Abundance ratio of aluminum atom}(\%)} \times 100 \quad \text{equation (1)}$$

<Measurement of BET Specific Surface Area of Zeolite>

The BET specific surface area of the zeolite is measured in conformity with JIS Z8830 (2001). A specific measurement method is as described below.

Used as a measuring apparatus is an "automatic specific surface area/pore distribution-measuring apparatus TriStar3000 (manufactured by Shimadzu Corporation)" adopting a gas adsorption method based on a constant volume method as a measuring system. The setting of measurement conditions and the analysis of measurement data are performed with a dedicated software "TriStar3000 Version 4.00" included with the apparatus. In addition, a vacuum pump, a nitrogen gas pipe arrangement and a helium gas pipe arrangement are connected to the apparatus. A value calculated by a BET multipoint method with a nitrogen gas as an adsorption gas is defined as the BET specific surface area in the present invention.

It should be noted that the BET specific surface area is calculated as described below.

First, the zeolite is caused to adsorb the nitrogen gas, and an equilibrium pressure P (Pa) in a sample cell and a nitrogen adsorption Va ($mol \cdot g^{-1}$) of the toner at that time are measured. Then, an adsorption isotherm is obtained, in which the axis of abscissa indicates a relative pressure Pr as a value obtained by dividing the equilibrium pressure P (Pa) in the sample cell by a saturated vapor pressure Po (Pa) of nitrogen and the axis of ordinate indicates the nitrogen adsorption Va ($mol \cdot g^{-1}$). Next, a monomolecular layer adsorption Vm ($mol \cdot g^{-1}$) as an adsorption needed for the formation of a monomolecular layer on the surface of the zeolite is determined by applying the following BET equation:

$$Pr/Va(1-Pr)=1/(Vm\times C)+(C-1)\times Pr/(Vm\times C)$$

(where C represents a BET parameter, a variable that varies depending on the kind of the measurement sample, the kind of the adsorption gas, and an adsorption temperature).

The BET equation can be interpreted as a straight line having a gradient of (C−1)/(Vm×C) and an intercept of 1/(Vm×C) when the X-axis indicates the Pr and the Y-axis indicates the Pr/Va(1−Pr) (the straight line is referred to as "BET plot").

$$\text{Gradient of straight line}=(C-1)/(Vm\times C)$$

$$\text{Intercept of straight line}=1/(Vm\times C)$$

Actual values for the Pr and actual values for the Pr/Va (1−Pr) are plotted on a graph, and a straight line is drawn by a least square method. As a result, values for the gradient and intercept of the straight line can be calculated. Solving the above simultaneous equations for the gradient and the intercept with those values can yield the Vm and the C.

Further, a BET specific surface area S ($m^2 \cdot g^{-1}$) of the zeolite is calculated from the Vm calculated in the foregoing and the molecule-occupied sectional area (0.162 $nm^2$) of a nitrogen molecule on the basis of the following equation:

$$S=Vm\times N\times 0.162\times 10^{-18}$$

(where N represents Avogadro's number ($mol^{-1}$)).

The measurement with the apparatus, which is in conformity with a "TriStar3000 Instruction Manual V4.0" included with the apparatus, is specifically performed according to the following procedure.

The tare weight of a dedicated sample cell made of glass (having a stem diameter of ⅜ inch and a volume of about 5 ml) that has been sufficiently washed and dried is precisely weighed. Then, about 0.15 g of the zeolite is loaded into the sample cell with a funnel.

The sample cell containing the zeolite is set in a "pretreatment apparatus VacuPrep 061 (manufactured by Shimadzu Corporation)" to which a vacuum pump and a nitrogen gas pipe arrangement are connected, and then vacuum deaeration is continued at 23° C. for about 10 hours. It should be noted that, at the time of the vacuum deaeration, the deaeration is gradually performed while a valve is adjusted lest the toner should be sucked by the vacuum pump. A pressure in the cell gradually reduces in association with the deaeration, and finally reaches about 0.4 Pa (about 3 mTorr). After the completion of the vacuum deaeration, a nitrogen gas is gradually injected to return the pressure in the sample cell to the atmospheric pressure, and then the sample cell is removed from the pretreatment apparatus. Then, the mass of the sample cell is precisely weighed, and the accurate mass of the toner is calculated from a difference between the tare weight and the mass. It should be noted that, at that time, the sample cell is capped with a rubber stopper during the weighing lest the zeolite in the sample cell should be contaminated with, for example, moisture in the air.

Next, a dedicated "isothermal jacket" is attached to a stem portion of the sample cell containing the zeolite. Then, a dedicated filler rod is inserted into the sample cell, and the sample cell is set in the analysis port of the apparatus. It should be noted that the isothermal jacket is a tubular member capable of sucking up liquid nitrogen to a certain level by capillarity and having an inner surface constituted of a porous material and an outer surface constituted of an impervious material.

Subsequently, the free space of the sample cell including a connecting device is measured. The free space is calculated in terms of a difference between two volumes, i.e., the volume of the sample cell measured at 23° C. with a helium gas and the volume of the sample cell after the cooling of the sample cell with liquid nitrogen measured in the same manner as that de scribed above with a helium gas. In addition, the saturated vapor pressure Po (Pa) of nitrogen is separately measured in an automatic manner with a Po tube built in the apparatus.

Next, vacuum deaerat ion in the sample cell is performed. After that, the sample cell is cooled with liquid nitrogen while the vacuum deaeration is continued. After that, a nitrogen gas is introduced into the sample cell in a stepwise manner so that the zeolite can be caused to adsorb nitrogen molecules. At that time, the adsorption isotherm can be obtained by measuring the equilibrium pressure P (Pa) whenever necessary, and the adsorption isotherm is converted into a BET plot. It should be noted that points of the relative pressure Pr at which data are collected are set to a total of six points, i.e., 0.05, 0.10, 0.15, 0.20, 0.25 and 0.30. A straight line is drawn for the resultant measurement data by a least square method, and the Vm is calculated from the gradient and intercept of the straight line. Further, the BET specific surface area of the zeolite is calculated with the value for the Vm as described above.

<Measurement of Primary Particle Diameter D50y of Zeolite Particles>

A primary particle diameter D50y of zeolite particles used in the present invention can be measured with an FE-SEM (S-800) manufactured by Hitachi, Ltd.

First, a digital observation image magnified at a magnification of 10,000 is obtained. Next, the primary particle diameter D50y of the zeolite is measured from the digital image with an image processing software Win-Roof (distributor: MITANI CORPORATION) as described below.

Attention is paid to each primary particle of a zeolite crystal on the image, and the circle-equivalent diameter of each primary particle is calculated from the area of the primary particle. The circle-equivalent diameters of 100 randomly selected particles are measured, and the median diameter D50y on a volume basis is calculated from the resultant particle diameters.

<Measurement of Agglomeration Diameter D50z of Zeolite Particles>

The measurement of the median diameter (D50z) on a volume basis of the agglomerate of the zeolite particles used in the present invention, which is in conformity with JIS 28825-1 (2001), is specifically performed as described below.

A laser diffraction/scattering particle size distribution-measuring apparatus "LA-920" (manufactured by HORIBA, Ltd.) is used as a measuring apparatus.

The setting of measurement conditions and the analysis of measurement data are performed with a dedicated software "HORIBA LA-920 for Windows (registered trademark) WET (LA-920) Ver. 2.02" included with the LA-920.

In addition, ion-exchanged water from which impure solid matter and the like have been removed in advance is used as a measurement solvent.

A measurement procedure is as described below.

(1) A batch type cell holder is attached to the LA-920.

(2) A predetermined amount of the ion-exchanged water is charged into a batch type cell, and the batch type cell is set in the batch type cell holder.

(3) The inside of the batch type cell is stirred with a dedicated stirrer chip.

(4) A "refractive index" button on a "display condition setting" screen is pushed, and a file "118A000I" (relative refractive index: 1.18) is selected.

(5) A basis for particle diameters is set to a volume basis on the "display condition setting" screen.

(6) After a warm-up has been performed for 1 hour or more, the adjustment of an optical axis, fine adjustment of the optical axis, and blank measurement are performed.

(7) About 60 ml of the ion-exchanged water are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with the ion-exchanged water by about three mass fold is added as a dispersant to the beaker.

(8) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared. About 3.3 1 of the ion-exchanged water are charged into the water tank of the ultrasonic dispersing unit, and then about 2 ml of the Contaminon N are added to the water tank.

(9) The beaker in the section (7) is set in the beaker-fixing hole of the ultrasonic dispersing unit, and the ultrasonic dispersing unit is operated. Then, the height position of the beaker is adjusted in order that the liquid surface of the aqueous solution in the beaker resonates with an ultrasonic wave from the ultrasonic dispersing unit to the fullest extent possible.

(10) About 1 mg of the zeolite is gradually added to and dispersed in the aqueous solution in the beaker in the section (9) in a state where the aqueous solution in the beaker is irradiated with the ultrasonic wave. Then, the ultrasonic dispersion treatment is continued for an additional sixty seconds.

It should be noted that the zeolite clusters to float on the liquid surface at that time. In that case, the cluster is sunk in water by shaking the beaker before the ultrasonic dispersion is performed for 60 seconds. In addition, the temperature of water in the water tank is appropriately adjusted so as to be 10° C. or more and 40° C. or less at the time of the ultrasonic dispersion.

(11) The aqueous solution in which the zeolite has been dispersed prepared in the section (10) is immediately added to the batch type cell gradually while attention is paid lest the aqueous solution should bear air bubbles. Then, adjustment is performed so that a transmittance for a tungsten lamp is 90% to 95%.

Then, a particle size distribution is measured. The median diameter (D50z) on a volume basis of the agglomerate is calculated on the basis of data on the resultant particle size distribution on a volume basis.

<Measurement of Median Diameter D50t on Number Basis of Toner Particles>

A precision grain size distribution measuring apparatus provided with a 100-μm aperture tube and based on a pore electrical resistance method "Coulter Counter Multisizer 3" (registered trademark, manufactured by Beckman Coulter, Inc.) is used as a measuring apparatus.

The setting of measurement conditions and the analysis of measurement data are performed with a dedicated software "Beckman Coulter Multisizer 3 Version 3.51" (manufactured by Beckman Coulter, Inc.) included with the apparatus. It should be noted that the measurement is performed with the number of effective measurement channels set to 25,000.

An electrolyte solution prepared by dissolving reagent grade sodium chloride in ion-exchanged water so as to have a concentration of about 1 mass %, for example, an "ISOTON II" (manufactured by Beckman Coulter, Inc.) can be used in the measurement.

It should be noted that the dedicated software is set as described below prior to the measurement and the analysis.

In the "change of standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value.

A threshold and a noise level are automatically set by pressing a "threshold/noise level measurement" button. In addition, a current is set to 1600 μA, a gain is set to 2, and an electrolyte solution is set to an ISOTON II, and a check mark is placed in a check box as to whether the "aperture tube is flushed after the measurement".

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction.

Then, dirt and bubbles in the aperture tube are removed by the "aperture flush" function of the dedicated software.

(2) About 30 ml of the electrolyte solution are charged into a 100-ml flat-bottom beaker made of glass.

About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by about three mass fold is added as a dispersant to the beaker.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared.

A predetermined amount of ion-exchanged water is charged into the water tank of the ultrasonic dispersing unit. About 2 ml of the Contaminon N is then added to the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker resonates with an ultrasonic wave from the ultrasonic dispersing unit to the fullest extent possible.

(5) About 10 mg of toner are gradually added to and dispersed in the electrolyte solution in the beaker in the section (4) in a state in which the electrolyte solution is irradiated with the ultrasonic wave. Then, the ultrasonic dispersion treatment is continued for an additional sixty seconds.

It should be noted that the temperature of water in the water tank is appropriately adjusted so as to be 10° C. or more to 40° C. or less upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the median diameter D50t on a number basis is calculated. It should be noted that an "average diameter" on the "analysis/number statistics (arithmetic average)" screen of the dedicated software when the dedicated software is set to show a graph in a number% unit is the median diameter D50t on a number basis of the toner.

<Measurement of Average Circularity of Toner>

The average circularity of the toner is measured by using a flow-type particle image analyzer "FPIA-2100" (manufactured by SYSMEX CORPORATION.). The measurement is described in detail below.

First, circularities are calculated from the following equation.

Circularity=(circumferential length of a circle having the same area as a particle projected area)/(circumferential length of a particle projected image)

Here, the term "particle projected area" refers to the area of a binarized particle image, and the term "circumferential length of a particle projected image" refers to the length of a borderline obtained by connecting the edge points of the particle image.

The measurement involves the use of the circumferential length of a particle image that has been subjected to image processing at an image processing resolution of 512×512 (pixel measuring 0.3 μm×0.3 μm).

The circularity in the present invention is an indicator for the degree of surface unevenness of a particle. The circularity is 1.000 when the particle is of a completely spherical shape. The more complicated the surface shape, the smaller the circularity.

In addition, an average circularity C meaning the average of a circularity frequency distribution is calculated from the following equation (2) when a circularity at a divisional section i in a particle size distribution is represented by ci and the number of measured particles is represented by m.

$$\text{Average circularity } C = \sum_{i=1}^{m} ci/m \qquad \text{equation (2)}$$

In addition, a circularity standard deviation SD is calculated from the following equation (3) when the average circularity is represented by C, the circularity of each particle is represented by ci, and the number of measured particles is represented by m.

$$\text{Circularity standard deviation } SD = \left\{\sum_{i=1}^{m} (C - ci)^2/m\right\}^{1/2} \qquad \text{equation (3)}$$

A specific measurement method is as described below.

First, about 10 ml of ion-exchanged water from which impure solid matter and the like have been removed in advance are charged into a glass container.

About 0.1 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with the ion-exchanged water by about three mass fold is added as a dispersant to the container.

Further, about 0.02 g of a measurement sample is added to the mixture, and the whole is subjected to a dispersion treatment for 2 minutes with an ultrasonic dispersing unit. Thus, a dispersion liquid for measurement is obtained.

Used as the ultrasonic dispersing unit is an ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W. It should be noted that a predetermined amount of the ion-exchanged water is charged into the water tank of the ultrasonic dispersing unit, and about 2 ml of the Contaminon N are added to the water tank. At that time, the dispersion liquid is appropriately cooled so as not to have a temperature of 40° C. or more.

In addition, in order that a variation in circularity is suppressed, the temperature of an environment where the flow-type particle image analyzer FPIA-2100 is placed is controlled at 23° C.±0.5° C. so that the temperature in the analyzer is 26 to 27° C.

In addition, automatic focusing is performed by using 2-μm standard latex particles (such as particles obtained by diluting "RESEARCH AND TEST PARTICLES Latex Microsphere Suspensions 5200A" manufactured by Duke Scientific with the ion-exchanged water) at a certain time interval, or preferably at an interval of 2 hours.

The circularities of the toner particles are measured with the flow-type particle image analyzer, and a particle sheath "PSE-900A" (manufactured by SYSMEX CORPORATION) is used as a sheath liquid.

The dispersion liquid prepared in accordance with the procedure is introduced into the flow-type particle image analyzer, and the measurement is performed by readjusting the concentration of the dispersion liquid so that a toner particle concentration at the time of the measurement is about 5000 particles/μl. After the measurement, the average circularity of the toner particles each having a circle-equivalent diameter in the range of 2.00 μm or more and less than 40.02 μm is determined by using the data.

It should be noted that the circle-equivalent diameter is a value calculated as described below.

Circle-equivalent diameter=(particle projected area/$\pi$)$^{1/2}$×2

The measuring apparatus "FPIA-2100" used in the present invention is an apparatus that has a reduced thickness of a sheath flow (7 μm→4 μm) and an increased magnification of a processed particle image as compared with an apparatus "FPIA-1000" that has been conventionally used for observing the shape of toner.

In addition, the apparatus has an increased processing resolution of a captured image (256×256→512×512) and improved accuracy of the shape measurement of toner.

EXAMPLES

Hereinafter, the present invention is described by way of examples, but the present invention is not limited to the examples. It should be noted that the number of part(s) in the following blending refers to part(s) by mass unless otherwise specified.

Production Example of Negative Charge Control Resin (1)

First, 250 parts by mass of methanol, 150 parts by mass of 2-butanone, and 100 parts by mass of 2-propanol as solvents, and 88 parts by mass of styrene, 6.5 parts by mass of 2-ethylhexyl acrylate, and 4.8 parts by mass of 2-acrylamide-2-methylpropanesulfonic acid as monomers were added to a pressurizable reaction vessel provided with a reflux pipe, a stirring machine, a temperature gauge, a nitrogen-introducing pipe, a dropping apparatus, and a decompression apparatus, and then the mixture was heated to a reflux temperature while being stirred.

A solution prepared by diluting 1 part by mass of 2,2'-azobisisobutyronitrile as a polymerization initiator with 20 parts by mass of 2-butanone was dropped to the mixture over 30 minutes, and the stirring was continued for 5 hours.

Further, a solution prepared by diluting 1 part by mass of 2,2'-azobisisobutyronitrile with 20 parts by mass of 2-butanone was dropped to the mixture over 30 minutes, and the whole was stirred for an additional five hours. Thus, polymerization was completed.

Next, the polymerization solvents were removed by distillation under reduced pressure. After that, the resultant polymer was coarsely pulverized into pieces each having a size of 100 μm or less with a cutter mill mounted with a 150-mesh screen, and furthermore, was finely pulverized with a jet mill.

The fine powder was classified with a 250-mesh sieve, and particles each having a size of 60 μm or less were obtained by separation. Next, methyl ethyl ketone (MEK) was added to dissolve the particles so that the resultant solution might have a concentration of 10%. The solution was gradually charged into methanol whose amount was 20 times as large as MEK so that reprecipitation might occur.

The resultant precipitate was washed with methanol whose amount was one half of that used for the reprecipitation, and filtered particles were vacuum-dried at 35° C. for 48 hours.

Further, MEK was added to re-dissolve the particles after the vacuum drying so that the resultant solution might have a concentration of 10%. The solution was gradually charged into n-hexane whose amount was 20 times as large as MEK so that reprecipitation might occur.

The resultant precipitate was washed with n-hexane whose amount was one half of that used for the reprecipitation, and filtered particles were vacuum-dried at 35° C. for 48 hours.

A polar polymer thus obtained had a Tg of about 83° C., a main peak molecular weight (Mp) of 215,000, an Mn of 11,900, and an Mw of 31,500.

In addition, composition measured with a $^1$H-NMR apparatus (EX-400 manufactured by JEOL Ltd.: 400 MHz) was true to the loadings. The resultant resin was defined as a negative charge control resin (1).

Toner Particle Production Example (1)

First, 60.0 parts by mass of ion-exchanged water, 300.00 parts by mass of a 0.1-mol/l aqueous solution of sodium phosphate, and 10.00 parts by mass of 1.00-mol/l hydrochloric acid were added to a four-necked container. Then, the mixture was stirred with a high-speed stirring apparatus TK-homomixer at 12,000 rpm, and its temperature was held at 60° C.

Next, 25.00 parts by mass of a 1.00-mol/l aqueous solution of $CaCl_2$ were added at one time to the mixture. Thus, an aqueous dispersion medium containing a fine, hardly water-soluble dispersion stabilizer $Ca_3(PO_4)_2$ was prepared.

| | |
|---|---|
| Styrene monomer | 78.00 parts by mass |
| n-butyl acrylate | 22.00 parts by mass |
| C.I. Pigment Blue 15:3 | 8.00 parts by mass |
| Styrene-based resin (polystyrene, Mw = 2880, Mw/Mn = 2.2) | 20.00 parts by mass |
| Polyester-based resin (isophthalic acid/propylene oxide-denatured bisphenol A (2-mol adduct)/propylene oxide-denatured bisphenol A (3-mol adduct) (molar ratio: 30:55:15)) | 8.00 parts by mass |
| Negative charge control resin (1) | 0.30 part by mass |
| Negative charge control agent (manufactured by Orient Chemical Industries Ltd.: BONTRON E88) | 0.70 part by mass |
| Wax (manufactured by NIPPON SEIRO CO., LTD: HNP-10) | 12.50 parts by mass |

The above-mentioned materials were dispersed with a TK-homomixer (manufactured by Tokushu Kika Kogyo) at 5000 rpm. After that, the mixture was heated to 65° C. so that the contents might be uniformly dissolved and dispersed. Thus, a polymerizable monomer composition was prepared.

First, 7.5 parts by mass of 1,1,3,3-tetramethylbutylperoxy-2-ethylhexanoate (75% toluene solution) as a polymerization initiator were added to the polymerizable monomer composition. Then, the mixture was charged into the aqueous dispersion medium while the number of revolutions of the stirring apparatus was set to 12,000 rpm.

Then, the resultant mixture was granulated for 10 minutes while the number of revolutions was maintained at 12,000 rpm. After that, the high-speed stirring apparatus was changed to a propeller stirrer, and the temperature inside the container was increased to 67° C. Then, the mixture was subjected to a reaction for 5 hours while being slowly stirred.

Next, the temperature inside the container was increased to 80° C. and maintained for 40 minutes. Then, the temperature was gradually cooled to 30° C. at a cooling rate of 1° C./min. Thus, a slurry 1 was obtained. Diluted hydrochloric acid was added to the container containing the slurry 1 to remove the dispersion stabilizer.

Further, the remainder was separated by filtration, washed, and dried. After that, the dried product was classified with a multi-division classifier utilizing Co and a effect. Thus, toner particles (1) having a median diameter D50t on a number basis of 6.3 μm were obtained. The resultant toner particles (1) had an average circularity of 0.985.

Toner Particle Production Example (2)

Toner particles (2) were obtained in the same manner as in the toner particle production example (1) except that the addition amount of the negative charge control resin (1) was changed from 0.30 part to 0.70 part. The resultant toner particles (2) had a median diameter D50t on a number basis of 6.5 μm and an average circularity of 0.980.

Toner Particle Production Example (3)

Toner particles (3) were obtained in the same manner as in the toner particle production example (1) except that the negative charge control resin (1) was not added. The resultant toner particles (3) had a median diameter D50t on a number basis of 7.2 μm and an average circularity of 0.975.

Toner Particle Production Example (4)

Binder resin [polyester resin (fumaric acid/terephthalic acid/trimellitic acid/ethylene oxide-denatured bisphenol A (3-mol adduct) (molar ratio: 21:11:9:59))] 100.00 parts by mass C.I. Pigment Blue 15:3 5.00 parts by mass Negative charge control resin (1) 0.30 part by mass Negative charge control agent (manufactured by Orient Chemical Industries Ltd.: BONTRON E88) 0.60 part by mass Wax (manufactured by NIPPON SEIRO CO., LTD: HNP-10) 5.00 parts by mass Divinylbenzene 0.30 part by mass The above-mentioned materials were preliminary mixed with a Henschel mixer to a sufficient extent, and were then melted and kneaded with a biaxial extruding kneader at an arbitrary barrel temperature. The molten kneaded materials were cooled and then coarsely pulverized with a hammer mill. The coarsely pulverized product was subjected to fine pulverization with a pulverizer based on a mechanical pulverization system as a first stage into particles each having a size of 10 μm or less. Further, the finely pulverized product obtained by the step of the first stage described above was further subjected to a pulverization treatment with the mechanical pulverizer with its pulverization conditions changed as a second stage. The finely pulverized product obtained by the step of the second stage was treated with a heat sphering apparatus at 67° C.

After that, the finely pulverized product obtained by the above-mentioned steps was classified and spheroidized with an apparatus capable of simultaneously performing classification and a surface modification treatment with a mechanical impact force. Thus, toner particles (4) having a median diameter D50t on a number basis of 8.1 μm were obtained. The toner particles (4) had an average circularity of 0.970.

Toner Particle Production Example (5)

Toner particles (5) were obtained in the same manner as in the toner particle production example (4) except that the addition amount of the negative charge control resin (1) was changed from 0.30 part to 10.00 parts. The resultant toner particles (5) had a median diameter D50t on a number basis of 8.7 μm and an average circularity of 0.965.

[External Additive (1)]

A commercially available zeolite (385HUA manufactured by TOSOH CORPORATION) is defined as an external additive (1). Table 1 shows the physical property values of the external additive (1).

[External Additive (2)]

A commercially available zeolite (630HOA manufactured by TOSOH CORPORATION) is defined as an external additive (2). Table 1 shows the physical property values of the external additive (2).

[External Additive (3)]

A commercially available zeolite (930NHA manufactured by TOSOH CORPORATION) is defined as an external additive (3). Table 1 shows the physical property values of the external additive (3).

[External Additive (4)]

A commercially available zeolite (390HUA manufactured by TOSOH CORPORATION) is defined as an external additive (4). Table 1 shows the physical property values of the external additive (4).

[External Additive (5)]

A commercially available zeolite (341NHA manufactured by TOSOH CORPORATION) is defined as an external additive (5). Table 1 shows the physical property values of the external additive (5).

[External Additive (6)]

A commercially available zeolite (ZEOSTAR PGS450 manufactured by Nippon Chemical Industrial CO., LTD.) is defined as an external additive (6). Table 1 shows the physical property values of the external additive (6).

[External Additive (7)]

A commercially available zeolite (330HUA manufactured by TOSOH CORPORATION) is defined as an external additive (7). Table 1 shows the physical property values of the external additive (7).

[External Additive (8)]

A commercially available zeolite (Zeolum A-3 100# manufactured by TOSOH CORPORATION) is defined as an external additive (8). Table 1 shows the physical property values of the external additive (8).

[External Additive (9)]

A commercially available zeolite (LUNAIUOS SP-PA manufactured by Kao Corporation) is defined as an external additive (9). Table 1 shows the physical property values of the external additive (9).

[External Additive (10)]

A commercially available zeolite (Silton B manufactured by MIZUSAWA INDUSTRIAL CHEMICALS, LTD.) is defined as an external additive (10). Table 1 shows the physical property values of the external additive (10).

[External Additive (11)]

A silica-alumina composite oxide formed by a flaming reaction is defined as an external additive (11). Table 1 shows the physical property values of the external additive (11).

TABLE 1

| | | External additive | | | | | | | | | | |
|---|---|---|---|---|---|---|---|---|---|---|---|---|
| | | (1) | (2) | (3) | (4) | (5) | (6) | (7) | (8) | (9) | (10) | (11) |
| Physical properties | Structure | Zeolite | Zeolite | Zeolite | Zeolite | Zeolite | Zeolite | Zeolite | Zeolite | Zeolite | Zeolite | Silica-alumina composite oxide |
| | Aluminum ratio (%) | 1.8 | 11.3 | 7.0 | 0.3 | 22.5 | 0.0 | 25.2 | 49.7 | 50.6 | 48.9 | 1.0 |
| | BET specific surface area ($m^2/g$) | 671 | 402 | 204 | 604 | 541 | 353 | 584 | 1 | 43 | 3 | 200 |
| | D50z (μm) | 2.3 | 5.7 | 5.1 | 6.2 | 3.3 | 9.7 | 6.3 | 7.9 | 9.7 | 3.3 | 0.1 |

Toner Production Example (1)

First, 0.3 part by mass of the external additive (1) and 1.7 parts by mass of a hydrophobic silica fine powder whose surface had been treated with hexamethyldisilazane (number-average primary particle diameter: 7 nm) were added to 100.0 parts by mass of the toner particles (1), and the contents were mixed with a Henschel mixer (manufactured by MITSUI MINING. CO., LTD.) at a number of revolutions of 4000 rpm for 300 seconds. Thus, a toner (1) was obtained.

Toner Production Examples (2) to (15)

Toners (2) to (15) were each obtained in the same manner as in the toner (1) except that: toner particles and an external additive shown in Table 2 were used; and the toner was produced under conditions shown in Table 2.

<Fogging>

Evaluations were performed under a normal-temperature, normal-humidity environment (N/N: temperature 23.5° C., humidity 60% RH), a low-temperature, low-humidity environment (L/L: temperature 15.0° C., humidity 10.0% RH), and a high-temperature, high-humidity environment (H/H: temperature 32.5° C., humidity 80.0% RH). Under each of the environments, a totally white image was output on an HP Photo Paper of a LETTER size (manufactured by Hewlett-Packard Company, 220 g/m$^2$) at a process speed of 50 mm/sec at the first sheet and after printing on 10,000 sheets.

A fogging density (%) was calculated from a difference between the whiteness of a white portion of the image thus printed out and the whiteness of the transfer paper measured with a "REFLECTOMETER" (manufactured by Tokyo Denshoku CO., LTD.). Then, the image was evaluated for image fogging on the basis of the following judgement criteria.

TABLE 2

| | | Toner particles | | | | | External additive (zeolite) | | |
|---|---|---|---|---|---|---|---|---|---|
| | Toner No. | Toner particle No. | Production method | Addition amount of negative charge control resin (part(s)) | D50t (μm) | Average circularity | External additive No. | Aluminum ratio (%) | Addition amount with respect to 100 parts of toner particles (part(s)) |
| Example 1 | (1) | (1) | Suspension polymerization method | 0.3 | 6.3 | 0.985 | (1) | 1.8 | 0.3 |
| Example 2 | (2) | (2) | Suspension polymerization method | 0.7 | 6.5 | 0.980 | (2) | 11.3 | 0.1 |
| Example 3 | (3) | (2) | Suspension polymerization method | 0.7 | 6.5 | 0.980 | (3) | 7.0 | 0.1 |
| Example 4 | (4) | (1) | Suspension polymerization method | 0.3 | 6.3 | 0.990 | (4) | 0.3 | 0.3 |
| Example 5 | (5) | (2) | Suspension polymerization method | 0.7 | 6.5 | 0.980 | (5) | 22.5 | 0.1 |
| Example 6 | (6) | (3) | Suspension polymerization method | — | 7.2 | 0.975 | (1) | 1.8 | 0.1 |
| Example 7 | (7) | (4) | Pulverization method | 0.3 | 8.1 | 0.970 | (1) | 1.8 | 0.3 |
| Example 8 | (8) | (5) | Pulverization method | 10.0 | 8.7 | 0.965 | (1) | 1.8 | 1.0 |
| Comparative Example 1 | (9) | (1) | Suspension polymerization method | 0.3 | 6.3 | 0.990 | — | — | — |
| Comparative Example 2 | (10) | (1) | Suspension polymerization method | 0.3 | 6.3 | 0.990 | (6) | 0.0 | 0.3 |
| Comparative Example 3 | (11) | (2) | Suspension polymerization method | 0.7 | 6.5 | 0.980 | (7) | 25.2 | 0.1 |
| Comparative Example 4 | (12) | (2) | Suspension polymerization method | 0.7 | 6.5 | 0.980 | (8) | 49.7 | 0.1 |
| Comparative Example 5 | (13) | (2) | Suspension polymerization method | 0.7 | 6.5 | 0.980 | (9) | 50.6 | 0.1 |
| Comparative Example 6 | (14) | (2) | Suspension polymerization method | 0.7 | 6.5 | 0.980 | (10) | 48.9 | 0.1 |
| Comparative Example 7 | (15) | (1) | Suspension polymerization method | 0.3 | 6.3 | 0.990 | (11) | 1.0 | 0.3 |

Example 1

Image evaluations to be described later were performed with the toner (1) and the following image-forming apparatus.

Hereinafter, specific evaluation method is described.

A reconstructed apparatus of a commercially available laser printer LBP-3700 (manufactured by Hewlett-Packard Company) (process speed: 150 mm/sec) was used as the image-forming apparatus. First, 150 g of the toner (1) were loaded into a cartridge, and then the cartridge was mounted on a cyan station. A dummy cartridge was mounted on any other station.

An image having a breadth of 20 cm with its toner laid-on level adjusted to 0.40 mg/cm$^2$ and its print percentage at a position distant from its tip by 5 cm adjusted to 1% was used as an image at the time of printout on 10,000 sheets. In addition, a XEROX 4024 paper of a LETTER size (manufactured by XEROX, 75 g/m$^2$) was used as transfer paper for printout on 10,000 sheets.

Rank A: A reflection density of less than 1.0%

Rank B: A reflection density of 1.0% or more and less than 3.0%

Rank C: A reflection density of 3.0% or more

<Fogging at Time of Standing>

After the completion of the above-mentioned evaluation for fogging, the cartridge was left to stand for 2 days under each of the environments while being placed in the machine that had been turned off.

After that, a totally white image was output on an HP Photo Paper of a LETTER size (manufactured by Hewlett-Packard Company, 220 g/m$^2$) at a process speed of 50 mm/sec.

A fogging density (%) was calculated from a difference between the whiteness of a white portion of the image thus printed out and the whiteness of the transfer paper measured with a "REFLECTOMETER" (manufactured by Tokyo Denshoku CO., LTD.). Then, the image was evaluated for image fogging on the basis of the following judgement criteria.

Rank A: A reflection density of less than 1.0%

Rank B: A reflection density of 1.0% or more and less than 3.0%

Rank C: A reflection density of 3.0% or more

<Transferring Performance>

After having been left to stand under a 0° C. environment (having a temperature of 0.0° C. and a humidity of 50% RH) for 10 hours, the printer was transferred to an extremely-low-temperature, low-humidity environment (having a temperature of 10.0° C. and a humidity of 15% RH) and left to stand for 1 hour. Under the environment (extremely-low-temperature, low-humidity environment), a totally black image was output on one sheet of a XEROX 4024 paper of a LETTER size (manufactured by XEROX, 75 g/m$^2$).

Transfer residual toner on a photosensitive member after the formation of the black image was taped with a Mylar tape, and then the Mylar tape was peeled. The Macbeth density of only a Mylar tape attached onto paper was subtracted from the Macbeth density of the peeled Mylar tape attached onto paper so that the density of the transfer residual toner might be determined.

It should be noted that the evaluation imitates a use environment under which the storage temperature of the printer during nighttime hours is about 0° C.

Rank A: The density of the transfer residual toner is less than 0.10.

Rank B: The density of the transfer residual toner is 0.10 or more and less than 0.20.

Rank C: The density of the transfer residual toner is 0.20 or more.

Examples 2 to 8

Image evaluations were each performed in the same manner as in Example 1 except that any one of the toners (2) to (8) was used instead of the toner (1) of Example 1. Table 3 shows the results of the evaluations.

Comparative Examples 1 to 7

Image evaluations were each performed in the same manner as in Example 1 except that any one of the toners (9) to (15) was used instead of the toner (1) of Example 1. Table 3 shows the results of the evaluations.

TABLE 3

| | Fogging | | | | | | Fogging at time of standing | | | |
|---|---|---|---|---|---|---|---|---|---|---|
| | L/L | | N/N | | H/H | | L/L | N/N | H/H | |
| | First sheet | After 10,000 sheets | First sheet | After 10,000 sheets | First sheet | After 10,000 sheets | After 10,000 sheets | After 10,000 sheets | After 10,000 sheets | Transferring performance |
| Example 1 | A | A | A | A | A | A | A | A | A | A |
| Example 2 | A | A | A | A | A | A | A | A | A | A |
| Example 3 | A | A | A | A | A | A | A | A | B | B |
| Example 4 | A | A | A | A | A | A | A | A | A | B |
| Example 5 | A | A | A | A | A | A | A | A | B | A |
| Example 6 | A | A | A | A | A | B | A | A | B | A |
| Example 7 | A | A | A | A | A | B | A | A | B | A |
| Example 8 | A | B | A | A | A | B | A | A | B | B |
| Comparative Example 1 | A | A | A | A | A | B | A | B | C | B |
| Comparative Example 2 | A | B | A | A | A | A | A | A | B | C |
| Comparative Example 3 | A | A | A | A | A | B | A | A | C | A |
| Comparative Example 4 | A | A | A | A | A | B | A | B | C | B |
| Comparative Example 5 | A | A | A | A | A | B | A | B | C | B |
| Comparative Example 6 | A | A | A | A | A | B | A | B | C | B |
| Comparative Example 7 | A | B | A | A | A | A | A | A | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-243660, filed Oct. 22, 2009 which is hereby incorporated by reference herein in its entirety.

What is claimed is:

1. A toner, comprising:

toner particles; and a zeolite as an external additive, wherein:

the zeolite contains at least silicon atoms and aluminum atoms; and a ratio of the aluminum atoms to a total of the silicon atoms and the aluminum atoms in the zeolite is 0.2 to 24.0%.

2. The toner according to claim 1, wherein the zeolite has a BET specific surface area of 350 $m^2/g$ or more and 750 $m^2/g$ or less.

3. The toner according to claim 1, wherein the toner particles each contain one of a polymer and a copolymer each having one of a sulfonic group, a sulfonate group and a sulfonic acid ester group.

4. The toner according to claim 1, wherein the toner particles are obtained by adding a polymerizable monomer composition containing at least a polymerizable monomer and a colorant to an aqueous medium, granulating the polymerizable monomer composition in the aqueous medium to form particles of the polymerizable monomer composition, and polymerizing the polymerizable monomer in each of the particles of the polymerizable monomer composition.

* * * * *